US009121154B1

(12) United States Patent
Johnson

(10) Patent No.: US 9,121,154 B1
(45) Date of Patent: Sep. 1, 2015

(54) DOCK KIT

(71) Applicant: Richard Steven Johnson, North Branch, MN (US)

(72) Inventor: Richard Steven Johnson, North Branch, MN (US)

( * ) Notice: Subject to any disclaimer, the term of this patent is extended or adjusted under 35 U.S.C. 154(b) by 79 days.

(21) Appl. No.: 13/986,903

(22) Filed: Jun. 17, 2013

Related U.S. Application Data

(63) Continuation of application No. 13/373,641, filed on Nov. 22, 2011, now abandoned, and a continuation-in-part of application No. 13/317,624, filed on Oct. 24, 2011, now abandoned.

(51) Int. Cl.
*E02B 3/20* (2006.01)
*E02B 3/06* (2006.01)

(52) U.S. Cl.
CPC .. *E02B 3/068* (2013.01); *E02B 3/20* (2013.01)

(58) Field of Classification Search
CPC ..... E02B 3/20
USPC ..... 405/218, 219, 220, 221; 52/846, 848, 52/849
See application file for complete search history.

(56) References Cited

U.S. PATENT DOCUMENTS

| | | | | | |
|---|---|---|---|---|---|
| 2,571,337 | A * | 10/1951 | Burnham | 405/218 |
| 3,867,802 | A * | 2/1975 | Murphy | 52/481.1 |
| 4,074,537 | A * | 2/1978 | Gronlie | 405/218 |
| 5,024,039 | A * | 6/1991 | Karhumaki | 52/846 |
| 5,156,493 | A | 10/1992 | Johnson | 405/221 |
| 5,195,281 | A * | 3/1993 | Kosko | 52/11 |
| 5,412,915 | A | 5/1995 | Johnson | 52/177 |
| 5,493,992 | A | 2/1996 | Johnson | 114/263 |
| 5,625,985 | A | 5/1997 | Johnson | 52/177 |
| 6,688,059 | B1 * | 2/2004 | Walker | 52/847 |
| 6,694,686 | B2 * | 2/2004 | Ready et al. | 52/302.1 |
| 6,695,541 | B1 * | 2/2004 | Spence | 405/218 |
| 6,971,210 | B2 * | 12/2005 | Kliegle et al. | 52/506.07 |
| 8,117,970 | B1 * | 2/2012 | Baez | 108/42 |
| 2002/0184850 | A1 * | 12/2002 | Kamenomostski | 52/800.1 |
| 2010/0031606 | A1 * | 2/2010 | Kamenomostski | 52/846 |

* cited by examiner

*Primary Examiner* — Frederick L Lagman
(74) *Attorney, Agent, or Firm* — Jacobson & Johnson LLC

(57) ABSTRACT

A dock and dock kit suitable for shipping from a manufacturing site to an erection site where a dock can be erected having elongated dock beams with a length that is greater than the length of any of the beams in the dock kit and the mateable beams have surfaces that are mateable and securable to each other through fasteners to form elongated dock beams with each of the mateable beams having supports thereon for receiving and holding a plurality of dock planks thereon.

19 Claims, 3 Drawing Sheets

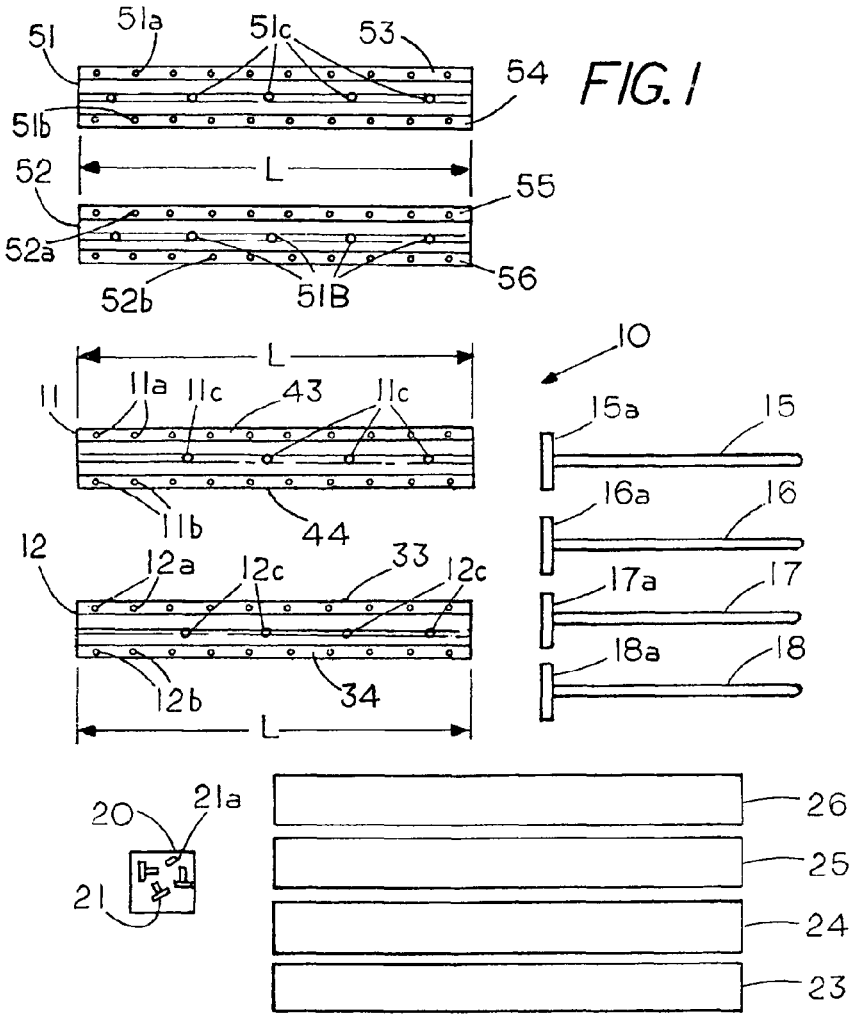
FIG. 1
FIG. 2
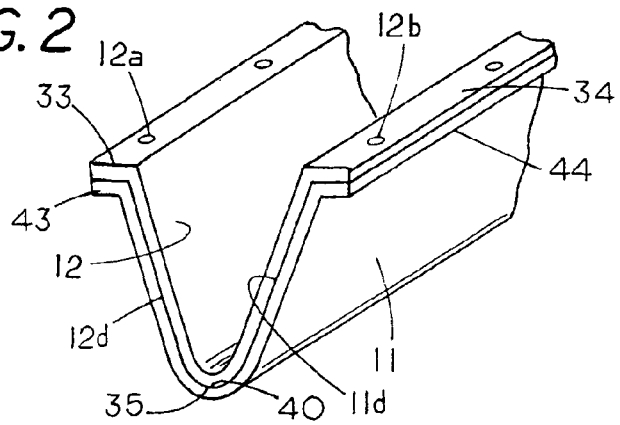

DOCK KIT

CROSS REFERENCE TO RELATED APPLICATIONS

This application is a continuation of application Ser. No. 13/373,641 filed Nov. 22, 2011 and a continuation in part of Ser. No. 13/317,624 filed Oct. 24, 2011.

FIELD OF THE INVENTION

This invention relates generally to docks and dock kits and, more specifically, to a universal dock kit.

STATEMENT REGARDING FEDERALLY SPONSORED RESEARCH OR DEVELOPMENT

None

REFERENCE TO A MICROFICHE APPENDIX

None

BACKGROUND OF THE INVENTION

The length and width of lake docks vary depending on the type of lakeshore as well as the preference of the lakeshore owner. The requests for various widths and lengths of docks usually requires that docks be made to order for each application sometimes in dock lengths which preclude conventional shipping methods. That is, most conventional carriers have a maximum length for goods that they will transport or if they do transport longer length goods the costs of the transport becomes so costly it becomes uncompetitive to make and ship the dock to a customer in a remote location.

While posts for supporting a dock can be located at different positions along the dock in order to have a stable dock surface it is desirable to have a set of at least two elongated dock beams that run the entire length of the dock for supporting the dock planks thereon. With the use of continuous elongated dock beams one is assured that the dock planks can be secured to the dock beams to form a stable walking surface. One such dock beam that is suitable for forming elongated dock beams is the Vee shaped dock beams used in docks sold by R & D Manufacturing Inc. of Forest Lake Minn.

Aside from the difficulty in shipping docks in dock kit form another difficulty is that different length dock beams need to be fabricated for each different dock length that a customer orders, which results in requiring a large inventory of dock beams in order to anticipate the orders for different length docks. On the other hand additional dock planks can easily be added to the dock kit to accommodate requests for different length docks. Thus, there is a need for a universal dock kit that could be assembled in different lengths and also avoids the shipping problems when the length of the dock beams exceed the carriers standard capacity.

The invention described herein comprises a universal dock kit for in situ formation of dock beams of various length docks without incurring the costs and shipping restrictions on oversize items and without having an excessive inventory of dock beams.

SUMMARY OF THE INVENTION

A universal dock and universal dock kit suitable for shipping from a manufacturing site to a lake site where a dock can be erected using in situ formation of elongated dock beams wherein the elongated dock beams supporting the dock planks have a length that is greater than the length of any of the beams in the dock kit. The dock kit including mateable beams that include male and female beams that have surfaces that are mateable and securable to each other through fasteners to form the elongated dock beam with each of the shorter male and female beams having supports thereon for receiving and holding a plurality of dock planks thereon and for holding the mateable beams in an interlocked condition while stiffening the elongated beam. The use of dock beams that can be assembled into different lengths allows the same dock kit to be used for a range of different length docks by merely adding additional dock planks to the dock kit.

BRIEF DESCRIPTION OF THE DRAWINGS

FIG. 1 shows an example of a dock kit of the invention;

FIG. 2 is a perspective view of mateable beams in surface-to-surface engagement with each other;

DESCRIPTION OF THE PREFERRED EMBODIMENT

Figure 2A:
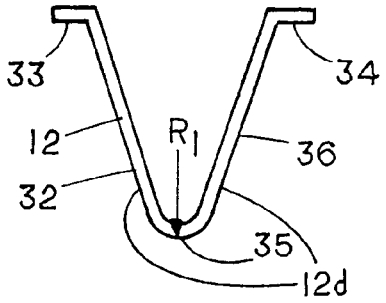
FIG. 2A is an end view of one of the mateable beams.

FIG. 1 shows a dock kit 10 including dock planks 23-26, dock hardware 20, dock posts 15-18, a first set of mateable beams 11 and 12 and a second set of mateable beams 51 and 52. Each of the set of mating beams can be overlapped and assembled to each other for forming an elongated dock beam which has a length longer than the length of the individual mating beams but less than the end to end length of the individual mating beams. The dock planks 23-26 can be secured to a pair of dock beams through the dock hardware 21. The dock posts 15-18 can be used to support the dock above the water.

In the example shown in FIG. 1 a first set of mateable beams 11 and 12 comprise a metal vee shaped male beam 11 having a fixed length L and a metal vee shaped female beam 12 having a fixed length L. Typically, beams 11 and 12 may be formed from a metal such as sheet aluminum, however, other materials may be used without departing from the spirit and scope of the invention. Beam 11 includes a set of lateral flanges 43 and 44 with flange 43 having a first set of spaced apart holes 11*a* and flange 44 having a second set of spaced apart holes 11*b* with each set of spaced apart holes extending in a regular pattern along the flanges and a third set of spaced apart holes 11*c* extending in a regular pattern along the apex end of the beam 11. Similarly, beam 12 includes a set of lateral flanges 33 and 34 with flange 33 having a first set of spaced apart holes 12*a* and flange 34 having a second set of spaced apart holes 12*b* a third set of spaced apart holes 12*c* extending in a regular pattern along the apex end of the beam 12 which each set of spaced apart holes extending in a regular pattern along the respective flanges and the apex end of beam 12 with the spacing between holes arranged so that a portion of the male beam 11 can be overlapped and secured to the female beam 12 through the extension of a set of fasteners 21, such as bolts, through the aligned holes in the flanges and the apex of the beams 11 and 12.

Similarly, the second set of mateable beams 51, 52 also comprises a first vee shaped male beam 51 having a first fixed length L and a second vee shaped female beam 52 having a second fixed length L. Beam 51 includes a set of lateral flanges 53 and 54 with flange 53 having a first set of spaced apart holes 51*a* and flange 54 having a second set of spaced apart holes 51*b* and a third set of spaced apart holes 51*c* extending in a regular pattern along the apex end of the beam 51 with each set of spaced apart holes extending in a regular pattern. Similarly, beam 52 includes a set of lateral flanges 55 and 56 with flange 55 having a first set of spaced apart holes 52*a* and flange 56 having a second set of spaced apart holes 52*b* and a third set of spaced apart holes 52*c* extending in a regular pattern along an apex end of the beam 52 which each set of spaced apart holes extending in a regular pattern along the respective flanges and the apex end with the spacing between holes arranged so that a portion of the male beam 51 can be overlapped and secured to the female beam 52 through the extension of a set of fasteners, such as bolts, through the aligned holes in the flanges and the apex end of the beams 51 and 52.

While dock beams can be manufactured in longer lengths the limitation on the length of goods that can be shipped from place to place makes it unfeasible to manufacture longer dock beams since not only is the shipping more difficult the cost of shipping increases substantially if a dock beam exceeds a certain length. Typically, most shippers limit the length of an article to a maximum of 10 feet in length, however, homeowners often need dock lengths in excess of ten feet, which requires having dock beams in excess of 10 feet.

A feature of the beams of the dock kit 10 is the use of shorter beams that can be assembled to each other to form a longer dock beam without the need for separate gusset plates or other tie members. A further feature is the ability to assemble shorter beams into a longer beam without the need of distorting the beams during the assemble of the beams into an elongated dock beam since the beams are mateable with each other thus reducing stress points on the elongated beam. A benefit of the inventions is that even though the mating beams may not be identical that when assembled the beams so closely resemble each other in physical appearance and size that the dock beams have a similar visual appearance to an observer so that the assembled dock beam appears as a continuous beam.

Figure 2B:
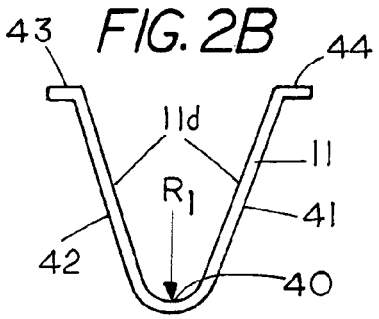
FIG. 2B is an end view of a mateable beam for forming surface to surface contact with the mateable beam of FIG. 2A.

To appreciate the feature of the mating beams reference should be made to FIGS. 2, 2A and 2B which show one example of the mateable beams for use in dock kit 10. FIG. 2 shows a perspective end view of beam 11, which is located within an internal cavity of beam 12. In the example shown the beams 11 and 12 have a surface-to-surface contact between the inside surface 11*c* of beam 11 the outside surface 12*c* of beam 12.

FIG. 2A shows an end view of beam 12 and FIG. 2B shows an end view of beam 11. The beam 11 includes angled sides 41 and 42 terminating in an internal apex 40 having an internal radius of curvature $R_1$ and includes an internal beam contact surface 11*d*. Beam 11 includes a first lateral flange 43 and a second lateral flange 44 for supporting dock planks thereon and for securing beam 11 beam 12 to each other.

Similarly, FIG. 2A shows an end view of beam 12 revealing the angled sides 32 and 36 terminating in an outside apex end 35 having an external radius of curvature $R_1$ and an external beam contact surface 12*d*. A first lateral flange 33 for supporting dock planks thereon extends from side 42 and a second lateral flange 44 for supporting dock planks thereon extends from side 41. The beam 12 includes angled sides 32 and 36 terminating in an external apex end 40 having an external radius of curvature $R_1$. Beam 12 includes a first lateral flange 33 and a second lateral flange 34 for supporting dock planks thereon and for securing dock planks to beam 11 beam 12.

Figure 6:
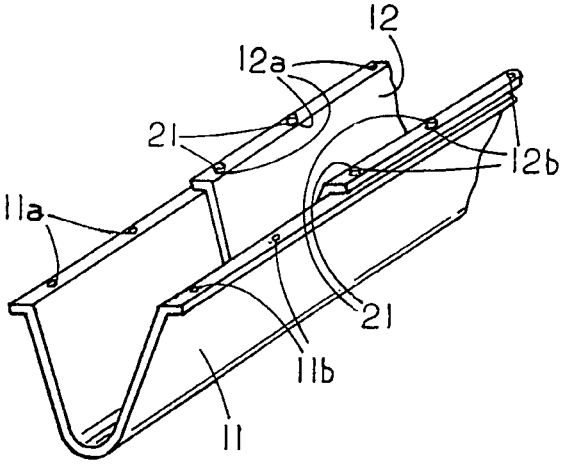
FIG. 6 is a perspective view of the overlapping section of two mateable beams.

As can be seem in FIG. 2, FIG. 2A and FIG. 2*b* the apex end of the female beam 11 has an inside radius of curvature $R_1$ and the apex end of male beam 12 has an external radius of curvature $R_1$ where the external radius of curvature of the male beam is equal or less than the inside radius of curvature of the female beam to enable beams 11 and 12 to mate in surface to surface contact with an inside surface 11*d* of female beam 11 with an outside surface 12*d* as illustrated in FIG. 2 and FIG. 6.

In the example shown the fixed length of the male beam and the fixed length of the female beam are each less than ten feet in order to accommodate carrier restrictions. In the in situ formation of an elongated dock beam described herein the lateral flanges of each of the male beam 12 and the female beam 11 have regular spaced holes, so the female beam 11 and the male beam 12 can be overlapped and secured to each other in a variety of different lengths as evidenced by dock beams 50, 51 and 52, which are shown in FIG. 3, FIG. 4 and FIG. 5.

Figure 3:
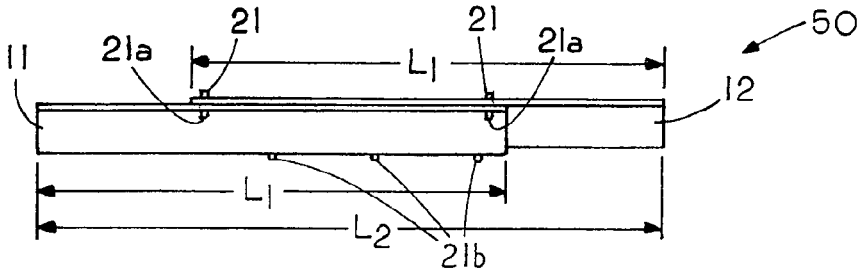
FIG. 3 shows two mateable beams located in an overlapping condition to form a dock beam.

FIG. 3 shows that the male beam 12 fits in the cavity of the female beam 11 with the flanges and the apex end of each beam in contact with each other and a set of fasteners 21 extending therethrough with nuts 21*a* thereon to hold the flanges and the apex end of the beams proximate each other so that beam 50 has a length $L_2$.

A further benefit from the mateable beams is that the overlapping section of the beams interlock with other in surface to surface contact so that the top fasteners and bottom fasteners 21 and 21*a*, which secure the flanges and apex ends of the beams to each other enable one to form the elongated dock beam from the shorter mateable beams. A further benefit of the overlapped beams is that the overlapping of the beams produce an elongated beam that is stiffer than an individual one-piece beam of similar length since the overlapped regions reinforce one another.

Figure 4:
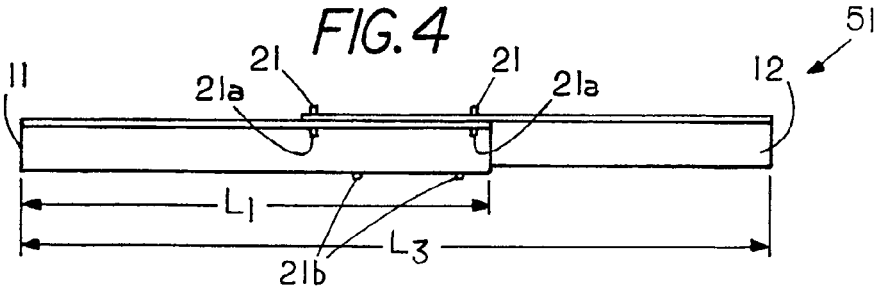
FIG. 4 shows two mateable beams located in a different overlapping condition to form a dock beam longer than the dock beam of FIG. 3.
Figure 5:
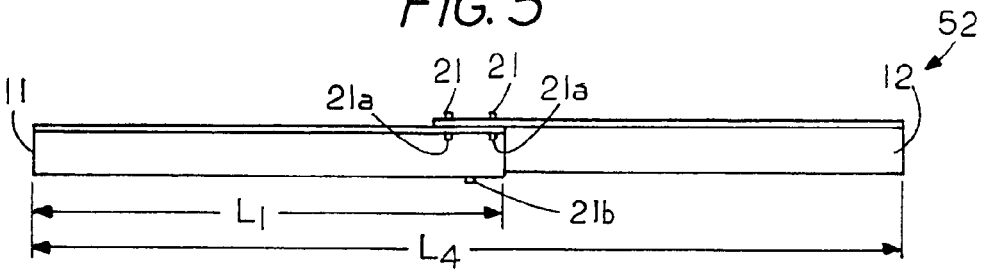
FIG. 5 shows two mateable beams located in a further overlapping condition to form a dock beam longer than the dock beam of FIG. 4.

FIG. 4 shows the mateable beams 11 and 12 which have been in situ formed into a dock beam 51 having a length $L_3$ and FIG. 5 shows the mateable beams 11 and 12 which have been in situ formed to a beam 52 having a length $L_4$ through a set of fasteners 21*a* and 21*b*. In each case the length of the beam formed by the overlapping beams 11 and 12 is greater than the length of either beam 11 or beam 12 but is less than the end-to-end length of beams 11 and 12 since a portion of each beam overlap each other. Although more material is required for fabricating a dock beam of given length if the dock beam is made of shorter beams the cost premium has been found to be insignificant in comparison to the costs and problems in shipping longer dock beams that exceed surface carriers normal size limit. In each case the spaced apart holes may be used to obtain the various lengths. If desired an operator may elect to form additional holes for additional fasteners if so desired.

In the example shown the fixed length of the female beam and the fixed length of the male beam in the dock kit are the same length although one may be longer than the other without departing from the spirit and scope of the invention.

While dock kit 10 shows examples of four dock planks 23, 24, 25, and 26, which are to be fixedly mounted transversely to the dock beams 11 and 12 with the hardware fasteners 21 shown in box 20. The actual number of dock planks included with the dock kit will depend on the ultimate length of the dock. Also included in dock kit 10 are a set of posts 15, 16, 17, and 18 with post 15 having a footpad 15*a*, post 16 having a footpad 16*a*, post 17 having a footpad 17*a* and post 18 having a footpad 18*a*. Similarly, the actual number of dock planks included with the dock kit will depend on the ultimate length of the dock. Thus a dock kit may contain more or less items with a basic dock kit generally including at least two sets of dock beams that can be assembled into longer dock beams.

FIG. 6 shows in perspective view an example of the overlapping of the first set of mateable beams 11 and 12 to form a single dock beam through the alignment of holes 11 a in beam 11 with holes 12*a* in beam 12 and the extension of a bolt 21 through the spaced apart holes in lateral flanges on each of the beams as well as through the apex end of each of the beams.

Thus, in one mode the invention comprises a dock kit 10 including a set of dock planks 23-26, a female beam 11 having a first fixed length $L_1$ and an apex end 40 having a set of regular spaced openings 11*c* with an inside beam contact surface 11*d* and a pair of opposite extending lateral flanges, a male beam 12 having a second fixed length and an apex end with an outside beam contact surface 12*d* and a pair of opposite extending lateral flanges 43, 44 where the outside beam contact surface 12*d* of the male beam 12 engages the inside contact beam surface 11*d* of the female beam when the female beam and the male beam are overlapped to thereby form an elongated dock beam such as dock beam 50, 51, or 52, which is of greater length than the length of either the female beam 11 or the male beam 12 but less than the end-to-end length of the female beam 11 and the male beam 12.

FIG. 3 is a side view of beam 11 and beam 12 and illustrates how beam 11 and beam 12 which each have a length $L_1$ can be assembled into a single dock beam having a length $L_2$ which is longer than either the dock beam 12 or dock beam 11 but less than an end-to-end length of beam 11 and beam 12. The dock beam 11 and dock beam 12 are secured to each other through a set of fasteners 21 and 21*b*, which may be bolts with nuts.

FIG. 4 is a further side view of dock beam 11 and beam 12 and illustrates how beam 11 and dock beam 12 which each have a length $L_1$ can be assembled into a single dock beam having a length $L_3$, which is longer than the dock beam 12 or dock beam 11 but less than an end-to-end length of beam 11 and beam 12. The dock beam 11 and dock beam are secured to each other through a set of fasteners 21 and 21*b*.

FIG. 5 is a side view of dock beam 11 and dock beam 12 and illustrates how beam 11 and beam 12 which each have a length $L_1$ can be assembled into a single dock beam having a length $L_4$ which is longer than the dock beam 12 or dock beam 11 but less than an end-to-end length of beam 11 and beam 12. The dock beam 11 and dock beam 12 are secured to each other through a set of fasteners 21 and 21*a*. Typically when the beams are secured to each other the beams include an overlap of at least two feet. However, the length of the overlap will depend on the material that the beams 11 and 12 are made from as well as the thickness and the shape of the mating beams. While mating beams 11 and 12 are shown as Vee shaped beams it is envisioned that other beams of other mateable shapes may also be used without departing from the spirit and scope of the invention described herein. While the mateable beams are secured with fasteners on the flange and preferably on the apex end of the beams in some cases the fasteners may be located on the sides of the beam to provide for securing the beams in another location other than the apex of the beam. For example, the spaced apart holes may be located in sides 12, 36 and 42, 41 without departing from the spirit and scope of the invention.

Figure 7:
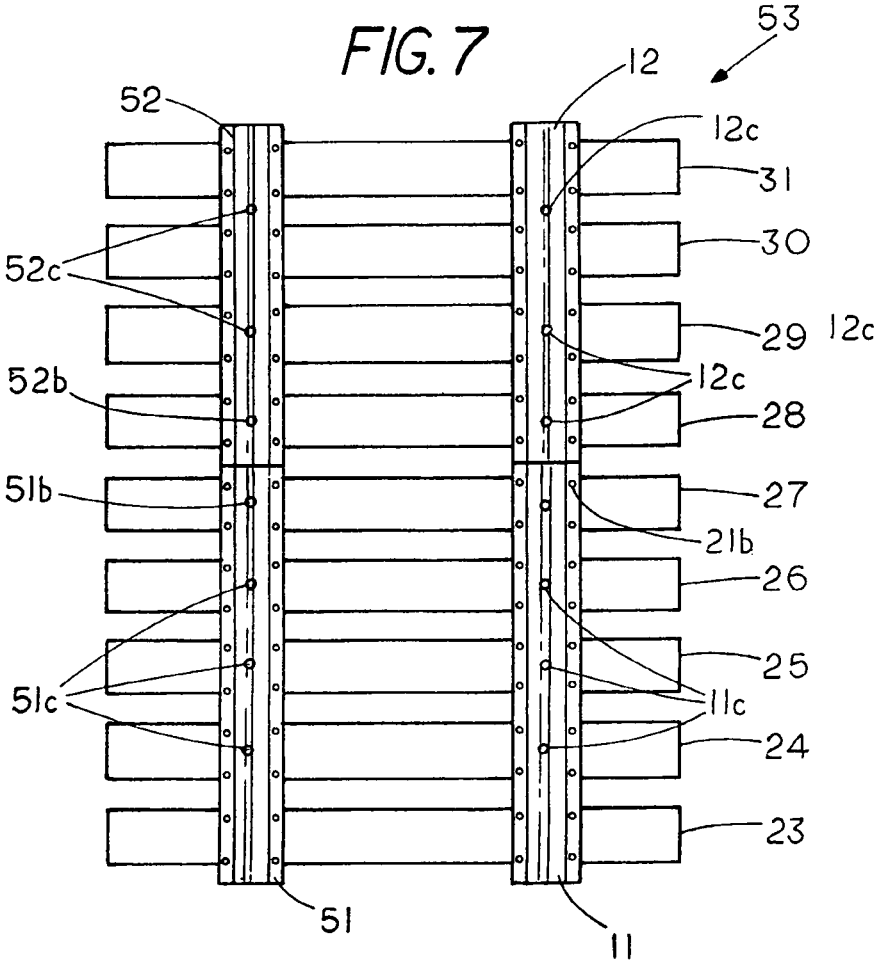
FIG. 7 is a bottom view of two sets of overlapping beams forming dock beams for supporting a plurality of dock planks thereon.

FIG. 7 shows a view of the underside of a dock having a first set of dock beams 11 and 12 located in an overlapped condition and a second set of dock beams 51 and 52 which are also located in an overlapped condition with each of the beams located parallel to each other and extending transverse to a set of dock planks 23-31 which are fastened thereto to form a dock 53.

Thus one aspect of the invention includes a method of manufacture of a dock kit 10 for shipment for on site assembly where the assembled dock has a length $L_3$ by forming a male beam 12 of a first length $L_1$ and a female beam 11 of a second length $L_2$ where the length $L_1$ or $L_2$ is less than $L_3$, forming a further male beam 51 of a further length $L_1$ and a further female beam 52 of a further length $L_2$ where the length $L_1$ or $L_2$ is less than $L_3$, forming a set of mating features such as a vee shape with an apex end in each of the male beams and each of the female beams. One then prepares customer instructions on assembly of the first male beam and the first female beam to form a first dock beam of length $L_3$ where $L_3$ is greater than $L_1$ and for assembling the further female beam and the further male beam to form a second dock beam of length $L_3$ where $L_3$ is greater than $L_1$ or $L_2$ including overlapping the first male beam to the first female beam to form the first elongated dock beam and securing the male beam to the female beam through fasteners 20 extending through aligned holes in flanges formed in the female beam and flanges formed in the male beam and through an apex end of the male beam and an apex end of the female beam and overlapping the further male beam to the further female beam to form the second dock beam and securing the further male beam to the further female beam through fasteners extending through aligned holes in the flanges and the apex end of each of the further male beam and the further female beam.

While the examples show the spaced apart holes located in the male and female beam in some cases the spaced apart holes may be formed on site when the male and female beam are located in a face to face condition as shown in FIG. 2.

I claim:

1. A dock kit including:

a set of dock planks;

a female beam having a first fixed length and an apex end with an inside beam contact surface and a pair of opposite extending lateral flanges;

a male beam having a second fixed length and an apex end with an outside beam contact surface and a pair of opposite extending lateral flanges, the apex end of the female beam having an inside radius of curvature and the apex end of male beam having an external radius of curvature where the external radius of curvature of the male beam is equal or less than the inside radius of curvature of the female beam and the outside beam contact surface of the male beam engages the inside contact beam surface of the female beam when the female beam and the male beam are overlapped to thereby form a dock beam of greater length than the length of either the female beam or the male beam but less than the end-to-end length of the female beam and the male beam; and a set of fasteners for securing the lateral flanges and the apex end of the male beam to the lateral flanges and the apex end the female beam when the male beam and the female beam are located in an overlapped condition.

2. The dock kit of claim 1 wherein the female beam and the male beam each have a vee shape and the dock kit includes at least two male beams and at least two female beams with a portion of the set of fasteners extending through the flanges of the male beam and the flanges of female beam and a further portion of the set of fasteners extending through the apex end of both the male beam and the female beam.

3. The dock kit of claim 2 wherein the first fixed length and the second fixed length are ten feet or less.

4. The dock kit of claim 1 wherein the lateral flanges of each of the male beam and the female beam have a set of regular spaced holes to permit the female beam and the male beam to be overlapped and secured to each other with top fasteners to thereby form an elongated dock beam in a variety of different lengths equal or greater than a length of either the male or the female beam.

5. The dock kit of claim 4 wherein the male beam is a metal male beam and the female beam is a metal female beam wherein the set of regular spaced holes are located in both the apex end of each of the male beam and the female beam and the flanges of the male beam and the flanges of the female beam.

6. The dock kit of claim 1 wherein the fixed length of the female beam and the fixed length of the male beam are the same and the length of a dock assembled from the dock kit can be increased by adding additional dock planks to the dock kit while maintaining the same length of the male beam and the female beam in the dock kit.

7. A dock comprising:

a first mateable beam having a fixed length, an inside radius of curvature and a surface for supporting a dock plank thereon;

a second mateable beam having a fixed length, an external radius of curvature where the external radius of curvature of the second mateable beam is equal or less than the inside radius of curvature of the first mateable beam and a surface for supporting a dock plank thereon with said first mateable beam mateable to said second mateable beam in an overlapping condition to thereby form a dock beam having a length longer then the length of either of the first mateable beam or the second mateable beam but less than an end to end length of the first mateable beam and the second mateable beam;

a third mateable beam having a fixed length, an inside radius of curvature and a surface for supporting a dock plank thereon;

a fourth mateable beam having a fixed length, an external radius of curvature where the external radius of curvature of the fourth mateable beam is equal or less than the inside radius of curvature of the third mateable beam and a surface for supporting a dock plank thereon with said third mateable beam mateable to said fourth mateable beam in an overlapping condition to form a second dock beam having a length longer then the length of either of the third mateable beam or the fourth mateable beam.

8. The dock of claim 7 wherein each of the mateable beams have a vee shape.

9. The dock of claim 7 wherein the first mateable beam and the second mateable beam comprise a male beam and a female beam secured to each other through a set of fastener extending through aligned holes in a flange and an apex of the first mateable beam and a flange and an apex in the second mateable beam.

10. The dock of claim 9 wherein the set of fasteners is a sole means of securing the male beam to the female beam.

11. The dock of claim 10 wherein a surface to surface contact between the male beam and the female beam maintains the female beam and the male beam in axial alignment with each other.

12. The dock kit of claim 7 wherein the first mateable beam and the second mateable are secured to each other through a top fastener extending through aligned holes in the surface for supporting the dock plank and a bottom fastener extending through aligned holes in an apex end of the first mateable beam and the second mateable beam with the first mateable beam and the second mateable beam in surface to surface contact on an overlapped portion to thereby maintain the mateable members in alignment with each other through the shape and relationship of the mateable members.

13. The dock kit of claim 7 wherein the first mateable beam and the second mateable beam have a length of 10 feet or less and the first mateable beam and the second mateable beam may be assembled into dock beams ranging in length from 11 feet to 18 feet.

14. The method of manufacture of a dock kit for shipment to a remote location for on site assembly where the assembled dock has a length $L_3$:

forming a first male beam of a first length $L_1$, and a first female beam of a second length $L_2$ where the length $L_1$ or $L_2$ is less than $L_3$ and the first female beam has an internal radius of curvature and the male beam has an external radius of curvature with the external radius of curvature of the first male beam is equal or less than the inside radius of curvature of the first female beam;

forming a further male beam of a further length $L_1$, and a further female beam of a further length $L_2$ where the further length $L_1$ or the further length $L_2$ is less than $L_3$ and the further female beam has an internal radius of curvature with an external radius of curvature of the further male beam is equal or less than the inside radius of curvature of the further female beam;

forming a set of mating features in each of the male beams and each of the female beams;

preparing instructions on assembly of first male beam and the first female beam to form a first dock beam of length $L_3$ where $L_3$ is greater than $L_1$ or $L_2$ and for assembling the further female beam and the further male beam to form a second dock beam of length $L_3$ where $L_3$ is greater than $L_1$ or $L_2$.

15. The method of claim 14 wherein the instructions include the steps:

overlapping the first male beam to the first female beam to form the first dock beam and securing the first male beam to the first female beam through a set of fasteners extending through aligned holes in a flange and an apex end of each of the first female beam and the first male beam; and overlapping the further male beam to the further female beam to form the second dock beam and securing the further male beam to the further female beam through fasteners extending through aligned holes in a flange and an apex end of each of the further male beam and the further female beam.

16. The method of claim 14 where the first male beam of a first length $L_1$ and the first female beam of a second length $L_2$ are different from one another.

17. The method of claim 16 wherein the first length $L_1$ of the first male beam and the second length $L_2$ of a second female beam are mated to each other the length $L_3$ is less than an end to end length of the first male beam of the first length $L_1$ and the second female beam of the second length $L_2$.

18. The method of claim 17 wherein each of the male and female beams are formed in a vee shape from a single sheet of metal.

19. The method of claim 18 wherein each of the male and female beams are formed with a set of lateral flanges for overlapping each other and for supporting a set of dock planks thereon and for securing each of the male and female beams to each other.

* * * * *